United States Patent [19]

Fischer et al.

[11] Patent Number: 4,828,677

[45] **Date of Patent: * May 9, 1989**

[54] PRODUCTION OF HIGH OCTANE GASOLINE

[75] Inventors: Ronald H. Fischer, Cherry Hill; Rene B. LaPierre, Medford; Stuart S. Shih, Cherry Hill; Philip Varghese, Voorhees, all of N.J.

[73] Assignee: Mobil Oil Corporation, New York, N.Y.

[ * ] Notice: The portion of the term of this patent subsequent to Jun. 30, 2004 has been disclaimed.

[21] Appl. No.: 115,309

[22] Filed: Nov. 2, 1987

Related U.S. Application Data

[63] Continuation-in-part of Ser. No. 940,382, Dec. 10, 1986, Pat. No. 4,738,768, which is a continuation-in-part of Ser. No. 825,294, Feb. 3, 1986, Pat. No. 4,676,887, which is a continuation-in-part of Ser. No. 740,677, Jun. 3, 1985, abandoned.

[51] Int. Cl.[4] ..... C10G 69/10

[52] U.S. Cl. ..... 208/89; 208/68; 208/111

[58] Field of Search ..... 208/111, 68, 69, 70, 208/89, 120

[56] References Cited

U.S. PATENT DOCUMENTS

| | | | |
|---|---|---|---|
| 3,245,900 | 4/1966 | Paterson | 208/68 |
| 3,287,254 | 11/1966 | Paterson | 208/68 |
| 3,867,277 | 2/1975 | Ward | 208/111 |
| 3,869,378 | 3/1975 | Pollock et al. | 208/68 |
| 3,897,327 | 7/1975 | Ward | 208/111 |
| 3,923,640 | 12/1975 | Wight | 208/111 |
| 4,097,365 | 6/1978 | Ward | 208/111 |
| 4,332,670 | 6/1982 | Antal | 208/68 |
| 4,435,275 | 3/1984 | Derr et al. | 208/111 |
| 4,585,545 | 4/1986 | Yancey, Jr. | 208/74 |
| 4,676,887 | 6/1987 | Fischer et al. | 208/61 |
| 4,683,050 | 7/1987 | Ward | 208/111 |
| 4,738,766 | 4/1988 | Fischer et al. | 208/68 |

*Primary Examiner*—Anthony McFarlane

*Attorney, Agent, or Firm*—Alexander J. McKillop; Charles J. Speciale; Malcolm D. Keen

[57] ABSTRACT

A moderate pressure hydrocracking process in which a highly aromatic, substantially dealkylated feedstock is processed directly to high octane gasoline by hydrocracking over a monofunctional acidic cracking catalyst, preferably comprising a large pore size, crystalline alumino-silicate zeolite hydrocracking catalyst such as zeolite Y. The feedstock which is preferably a light cycle oil obtained from catalytic cracking with an aromatic content of at least 50, usually at least 60 percent and an API gravity not more than 25. The hydrocracking typically operates at 600–1000 psig at moderate to high conversion levels to mazimize the production of monocyclic aromatics which provide the requiste octane value to the product gasoline.

24 Claims, 4 Drawing Sheets

NAPHTHA QUALITY

HYDROGEN CONSUMPTION

PRODUCTION OF HIGH OCTANE GASOLINE

CROSS REFERENCE TO RELATED PATENT APPLICATIONS

This application is a continuation-in-part application of U.S. patent application Ser. No. 940,382, filed Dec. 10, 1986, now U.S. Pat. No. 4,738,76. Ser No. 940,382 is a continuation-in-part of Ser. No. 825,294, filed Feb. 3, 1986, now U.S. Pat. No. 4,676,887, in the name of R. H. Fischer et al, which was a continuation-in-part application of U.S. patent application Ser. No. 740,677, filed June 3, 1985, in the name of R. H. Fischer et al which is now abandoned.

The subject matter of the three prior applications identified above is incorporated in the present application.

FIELD OF THE INVENTION

This invention relates to the production of high octane gasoline and more particularly to the production of high octane gasoline by hydrocracking highly aromatic fractions obtained from catalytic cracking and other petroleum refinery operations.

BACKGROUND OF THE INVENTION

Under present conditions, petroleum refineries are finding it necessary to convert increasingly greater proportions of crude to premium fuels such as gasoline and middle distillates such as diesel and jet fuel. Catalytic cracking processes, exemplified by the fluid catalytic cracking (FCC) process and Thermofor catalytic cracking (TCC) process together, account for a substantial fraction of heavy liquids convertion in modern refineries. Both are thermally severe processes which result in a rejection of carbon to coke and to residual fractions; during catalytic cracking high molecular weight liquids disproportionate into relatively hydrogen-rich light liquids and aromatic, hydrogen-deficient heavier distillates and residues.

Catalytic cracking in the absence of hydrogen does not provide significant desulfurization nor is the nitrogen content of the feed selectively rejected with the coke. Both sulfur and nitrogen therefore concentrate appeciably in the heavier cracking products. Cracking therefore produces significant quantities of highly aromatic, hydrogen-deficient middle and heavy distillates that have high sulfur and nitrogen levels. Recycling these liquids to the catalytic cracker is often not an attractive option, because they are refractory and difficult to convert and often will impair conversion of the less refractory fresh feed. Generally, the level of heteroatom contaminants increases with the boiling point of the fraction, as shown in Table 1 below which gives the sulfur and nitrogen contents for two typical FCC product fractions, a light cycle oil and an FCC main column bottoms (proportions and percentages by weight, as in the remainder of this specification unless the contrary is stated).

TABLE 1

| | FCC Product Fractions | | | |
|---|---|---|---|---|
| | Aromatics; wt. pct. | S, wt. pct. | N, ppmw | H, wt. pct. |
| Light Cycle Oil | 80 | 3.1 | 650 | 9.1 |
| Main Column Bottoms | 80+ | 4.6 | 1500 | 6.8 |

Present market requirements make refractory product streams such as these particularly difficult to dispose of as commercially valuable products. Formerly, the light and heavy cycle oil and FCC main column bottoms could be upgraded and sold as light or heavy fuel oil, such as No. 2 fuel oil or No. 6 fuel oil. Upgrading the light cycle oil was conventionally carried out by a relatively low severity, low pressure catalytic hydrodesulfurization (CHD) unit in which the cycle stock would be admixed with virgin mid-distillates from the same crude blend fed to the catalytic cracker. Further discussion of this technology is provided in the *Oil and Gas Journal,* May 31, 1982, pp. 87–94.

Currently, however, the refiner is finding a diminished demand for fuel oil. At the same time, the impact of changes in supply and demand for petroleum has resulted in a lowering of the quality of the crudes available to the refiner; this has resulted in the formation of an even greater quantity of refractory cycle stocks. As a result, the refiner is left in the position of producing increased amounts of poor quality cycle streams from the catalytic cracker while having a diminishing market in which to dispose of these streams.

At many petroleum refineries, the light cycle oil (LCO) from the FCC unit is a significant component of the feed to the catalytic hydrodesulfurization (CHD) unit which produces No. 2 fuel oil or diesel fuel. The remaining component is generally virgin kerosene taken directly from the crude distillation unit. The highly aromatic nature of LCO, particularly when the FCC unit is operated in the maximum gasoline mode, increases operational difficulties for the CHD and can result in a product having marginal properties for No. 2 fuel oil or diesel oil, as measured by cetane numbers and sulfur content.

An alternative market for mid-distillate streams is automotive diesel fuel. However, diesel fuel has to meet a minimum cetaine number specification of about 45 in order to operate properly in typical automotive diesel engines. Because cetane number correlates closely and inversely with aromatic content, the highly aromatic cycle oils from the cracker typically with aromatic contents of 80% or even higher have cetane numbers as low as 4 or 5. In order to raise the cetane number of these cycle stocks to a satisfactory level by the conventional CHD technology described above, substantial and uneconomic quantities of hydrogen and high pressure processing would be required.

Because of these problems associated with its use as a fuel, recycle of untreated light cycle oil to the FCCU has been proposed as a method for reducing the amount of LCO. Benefits expected from the recycle of LCO include conversion of LCO to gasoline, backout of kerosene from No. 2 fuel oil and diminished use of cetane improvers in diesel fuel. However, in most cases, these advantages are outweighed by disadvantages, which include increased coke make in the FCC unit, diminished quality of the resultant LCO and an increase in heavy cycle oil and gas.

A typical LCO is such a refractory stock and of poor quality relative to a fresh FCC feed that most refineries do not practice recycle of the untreated LCO to any significant extent. One commonly practiced alternative method for upgrading the LCO is to hydrotreat severely prior to recycle to the catalytic cracker or, alternatively, to hydrotreat severely and feed to a high pressure fuels hydrocracker. In both such cases, the object of hydrotreating is to reduce the heteroatom content to low levels while saturating polyaromatics to increase crackability. Although this does enhance the convertibility of these aromatic streams considerably, the economic penalties derived from high hydrogen consumptions and high pressure processing are severe. In addition, in those instances where the production of gasoline is desired, the naphtha may require reforming to recover its aromatic character and meet octane specifications.

Hydrocracking may be used to upgrade the higher-boilinhg more refractory products derived from catalytic cracking. The catalytic cracker is used to convert the more easily cracked paraffinic gas oils from the distillation unit while the hydrocracking accepts the dealkylated, aromatic cycle oils from the cracker and hydrogenates and converts them to lighter oils. See Petroleum Refining; Second Ed.; Gary, J. H and Handwerk, G. E.; Marcel Dekker, N.Y. 1984; pp. 138–151; Modern Petroleum Technology, Fourth Ed.; Hobson, G. D., Applied Science Publ. 1973; pp. 309–327. These hydrocracking processes using catalytically cracked feeds either on their own or mixed with virgin feeds have, however, generally been incapable of producing high octane gasoline directly. The reason for this is that they have conventionally been operated at high hydrogen pressures and at relatively high conversion levels so as to maximize the saturation of the aromatics (especially the refractory polynuclear aromatics), removal of heteroatoms in inorganic form and the subsequent conversion of the hydrogenated aromatics to paraffins. While this may produce acceptable diesel fuel (which benefits from the presence of n-paraffins) the octane quality of the gasoline has generally been poor as a consequence of the large quantities of low octane paraffin components. For present day use these gasolines will require extensive reforming with its consequent yield loss in order to conform to market produce specifications. To illustrate, U.S. Pat. No. 3,132,090 discloses the use of a two-stage hydrocracking scheme to produce gasoline. However, the octane number of the gasoline using a virgin distillate as charge is reported as 68 (RON+0). An octane of 80 (RON+3) is disclosed for a charge-stock of coker distillate and thermally cracked gas oils. The "high octane" gasolines described in this patent contain 3 ml/gallon of tetraethyl lead (TEL) and are in the range of 70–88 (RON+3). Because TEL adds about 4–6 octane numbers these gasolines have an octane rating on a clear basis (RON+0) in the range of 65–83 (RON+0).

Various low pressure hydrocracking processes have also been described. For example, U.S. Pat. Nos. 3,867,277 and 3,923,640 disclose low pressure hydrocracking processes using various high boiling feedstocks, generally of high (20–40) API gravity. The use of such feeds, coupled with the relatively high levels of conversion in those processes lead to naphthas of low octane rating since the alkyl groups present in the feeds come through into the naphtha together with the relatively straight chain paraffins produced by the ring opening and cracking of the aromatics. These processes have therefore been unsatisfactory for the direct production of high octane gasoline.

Other low pressure hydrocracking processes producing aromatic products have been described in the past but their potential for producing high octane gasoline from low value, refractory cracking oils has not been appreciated. For example, U.S. Pat. No. 4,435,275 describes a method for producing aromatic middle distillates such as some heating oil from high gravity feeds under relatively low conversion conditions but with the objective of producing low-sulfur middle distillates, octane numbers of only about 78 (R+0P) are reported.

A notable advance is described in U.S. Pat. No. 4,676,887 to which reference is made for details. It was found that highly aromatic, refractory feeds derived from catalytic cracking and other refinery operations could be converted directly to high octane gasoline by hydrocracking at relatively low pressures, typically 600–1000 psig (about 4250–7000 kPa. abs.) and with low conversions, typically below 50 weight percent to 385° F.−(195° C.−) products. (All SI equivalents in this specification are rounded off to a convenient figure so as to permit convenient comparison; all pressures quoted in SI units are absolute pressures). By using a highly aromatic feed which has been substantially dealkylated, for example in a catalytic cracking operation, typically with an API gravity of 5–25, the hydrocracking proceeds with only a limited degree of aromatics saturation so that a large quantity of single-ring alkylaromatics (mainly benzene, toluene, xylenes and trimethyl benzenes) are obtained by ring opening of partial hydrogenation products of bicyclic aromatics. The single ring aromatics are not only in the gasoline boiling range but also possess high octane numbers so that a high octane gasoline is produced directly, suitable for blending into the refinery gasoline pool without prior reforming.

A further development of this technique is described in U.S. application Ser. No. 940,382, in which high octane gasoline is produced from a relatively lower boiling fraction of the aromatic feed from the catalytic cracking operation. By the use of these light cut feeds, conversion may be raised to higher levels without adversely affecting gasoling octane or catalyst aging rate.

In the process, the dealkylated feed is treated in two reactors either with or without interstage separation of inorganic nitrogen and sulfur and light ends. The first reactor in the sequence is a hydrotreating reactor containing a conventional hydrotreating catalyst comprising a metal with hydrogenation functionality on a non-acidic porous support, for example, nickel-molybdenum on alumina. The second reactor contains a hydrocracking catalyst with both acidic, cracking functionality and hydrogenation functionality. The hydrogenation functionality is provided by a metal usually of Groups VIA or VIIIA of the Periodic Table (IUPAC Table) and the acidic functionality by a porous, inorganic, acidic solid, preferably a large pore size zeolite such as zeolite X or zeolite Y with a porous binder such as alumina, silica or silica-alumina.

SUMMARY OF THE INVENTION

We have now found that the hydrocracking may be carried out using a catalyst which is essentially free of the metal hydrogenation component. This is unexpected because hydrocracking is generally regarded as a process requiring a bifunctional catalyst: the hydrogenation (metal) functionality promotes the hydrogenation reactions and the acidic function promotes the cracking and ring-opening reactions.

The hydrocracking process operates with a substantially dealkylated feed as described in U.S. Pat. No. 4,676,887 to produce a high octane gasoline product using relatively low hydrogen pressure and hydrogen consumptions. The process runs with acceptable cycle durations and may be operated in continuous flow process with cyclic catalyst regeneration.

According to the present invention the process for producing a high octane gasoline boiling range product from a substantially dealkylated hydrocarbon feedstock employs a hydrocracking catalyst which is substantially free of hydrogenation functionality conferred by an added metal component. The hydrocracking catalyst therefore consists essentially of a porous, inorganic solid having acidic functionality, preferably a large pore size zeolite in a porous inorganic oxide matrix such as alumina, silica or silica-alumina. The hydrocracking step is preceded by a hydrotreating and an interstage separation of light ends and inorganic nitrogen and sulfur (ammonia and hydrogen sulfide) may optionally be interposed.

THE DRAWINGS

DETAILED DESCRIPTION

Feedstock

Figure 1:
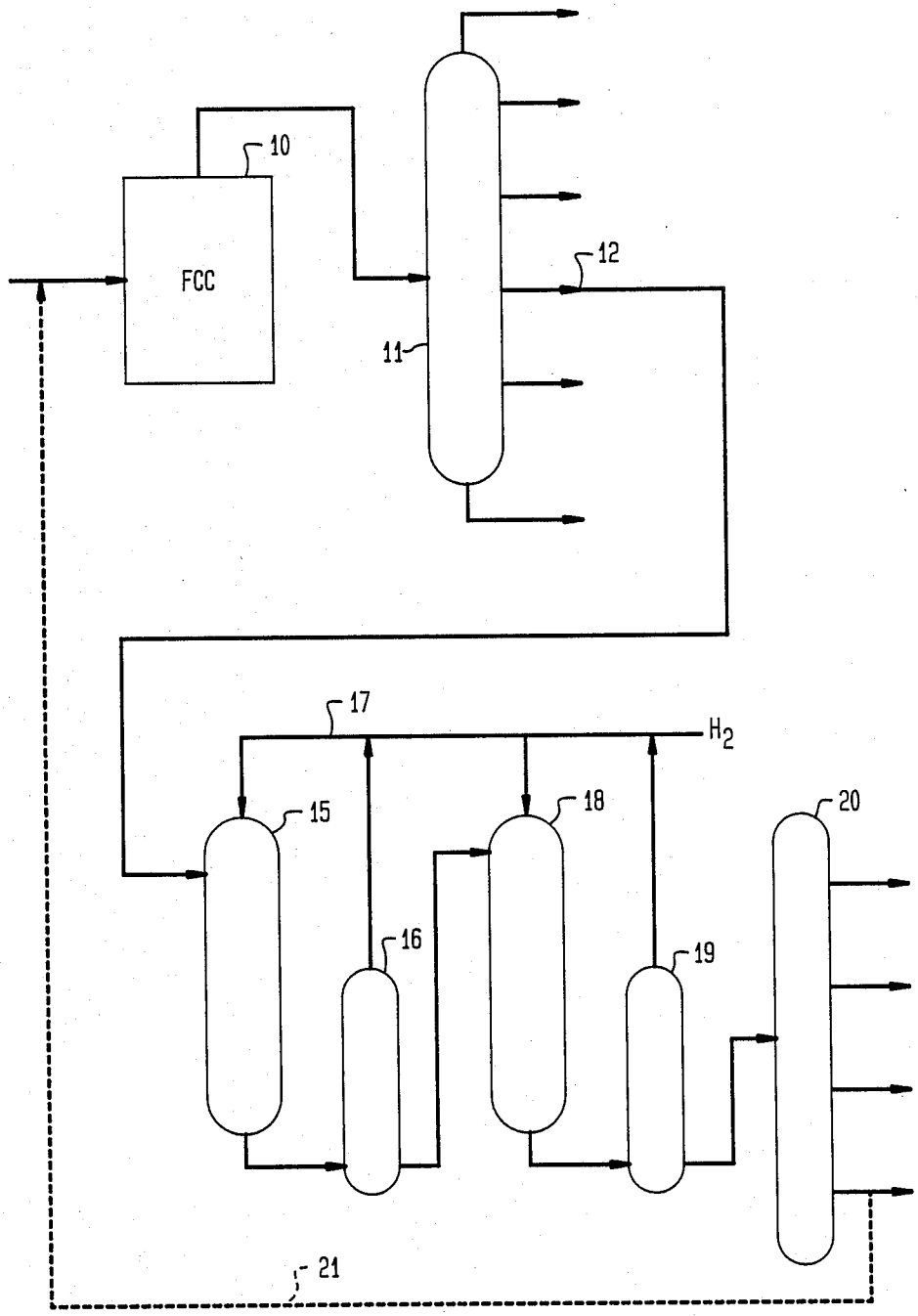
FIG. 1 is a simplified schematic of a unit for carrying out the present process.

The feeds used in the present process are hydrocarbon fractions which are highly aromatic and hydrogen deficient. They are fractions which have been substantially dealkylated, as by a catalytic cracking operation, for example, in an FCC or TCC unit. Dealkylated feeds may also be obtained from other refinery units such as delayed, contact or fluid bed coking units. However, catalytic cracking units will generally provide the bulk of the feed and the invention will be described with reference to feeds from such units. It is a characteristic of catalytic cracking that the alkyl groups, generally bulky, relatively large alkyl groups (typically but not exclusively $C_5$–$C_9$ alkyls), which are attached to aromatic moieties in the feed become removed during the course of cracking. It is these detached alkyl groups which lead to the bulk of the gasoline product from the cracker. The aromatic moieties such as benzene, naphthalene, benzothiophenes, dibenzothiophenenes and polynucler aromatics (PNAs) such as anthracene and phenanthrene from the high boiling products from the cracker. The mechanisms of acid-catalyzed cracking and similar reactions remove side chains of greater than 5 carbons while leaving behind short chain alkyl groups primarily methyl, but also ethyl groups on the aromatic moieties. Thus, the "substantially dealkylated" cracking products include those aromatics with small alkyl groups, such as methyl, and ethyl, and the like still remaining as side chains, but with relatively few large alkyl groups, i.e., the $C_5$–$C_9$ groups, remaining. More than one of these short chain alkyl groups may be present, for example, one, two or more methyl groups.

Feedstocks of this type have an aromatic content in excess of 50 wt. percent; for example, 70 wt. percent or 80 wt. percent or more, aromatics. Highly aromatic feeds of this type typically have hydrogen contents below 14 wt. percent, usually below 12.5 wt. percent or even lower, e.g. below 10 wt. percent or 9 wt. percent. The API gravity is also a measure of the aromaticity of the feed, usually being below 30 and in most cases below 25 or even lower, e.g. below 20. In most cases the API gravity will be in the range 5 to 25 with corresponding hydrogen contents from 8.5–12.5 wt. percent. Sulfur contents are typically from 0.5–5 wt. percent and nitrogen from 50–1000 ppmw.

The feeds for the present process may therefore be full range cycle oils with end points up to about 750° F. (400° C.) or a light out cycle oil with an end point up to about 650° C. (345° C.). The use of light cut cycle oils with end points below 650° F. (345° C.) preferably below 600° (315° C.) is desirable because their high conversion levels may be tolerated during the hydrocracking without excessive catalyst aging. If full range cycle oils are used with end points above about 650° F. (345° C.), it is desirable to limit conversion to the levels specified in U.S. Pat. No. 4,676,887, i.e. to below 50% per pass to gasoline boiling range products (385° F.−, 196° C.−) and preferably to a value related to the hydrogen pressure employed (not more than 0.05 times the hydrogen pressure expressed in psig). Reference is made to U.S. Pat. No. 4,676,887 for a description of the applicable process conditions.

Suitable feeds for the present process therefore include substantially dealkylated cracking product fractions with an end point below 650° F. (345° C.), preferably below 600° F. (315° C.). Initial boiling point will usually be 300° F. (150° C.) or higher, e.g. 330° F. (165°) or 385° F. (195° C.). Light cut light cycle oils (LCOs) within these boiling ranges ae highly suitable.

Full range light cycle oils (FRLCO) generally have a boiling point range between 385° and 750° F. (195°–400° C.) and may also be used. Light cycle oils generally contain from about 60 to 80% aromatics and, as a result of the catalytic cracking process, are substantially dealkylated. Other examples of suitable feedstocks include the dealkylated liquid products from delayed or fluid bed coking processes.

The use of the dealkylated feeds is a significant feature of the process. It will not produce high octane gasoline from predominantly virgin or straight run oils and which have not been previously dealkylated by processes such as catalytic cracking or coking. If the feed used in the present process has not been previously dealkylated, the large alkyl groups found in the feed will be cracked off during the hydrocracking and will be found in the resulting naphtha fraction. Because these groups are relatively straight chain, a low octane gasoline product will result. Smaller, i.e., $C_1$–$C_3$, alkyl side groups, if present do not appear in the naphtha boiling range products from the hydrocracker (even if conditions are severe enough to remove them) and so they have no effect on product octane. If a mixture of dealkylated and non-dealkylated feedstock is used, the octane number will be intermediate between the octane numbers of the feeds used separately. A mixture of alkylated and dealkylated feedstocks can be used in commercial operation but if so, it is likely that the gasoline will have to be subjected to a reforming process in order to achieve the desired octane.

Hydrocracking Catalyst

The catalyst used for the hydrocracking step is a monofunctional, heterogeneous, porous solid catalyst possessing acidic (cracking) and functionality but, at least in its initial stage prior to use, is essentially free of hydrogenation functionlity. Because the highly aromatic feed contains relatively bulky bicyclic and polycyclic components the catalyst should have a pore size which is sufficiently large to admit these materials to the interior structure of the catalyst where cracking can take place. A pore size of at least about 7.4 A (corresponding to the pore size of the large pore size zeolites X and Y) is sufficient for this purpose but because the end point of the feed is limited, the proportion of bulky, polynuclear aromatics is quite low and for this reason, very large pore sizes greatly exceeding those previously mentioned are not required. Crystalline zeolite catalysts which have relatively limited pore size range, as compared to the so-called amorphous materials such as alumina or silica-alumina, may therefore be used to advantage is view of their activity and resistance to poisoning. Catalysts having aromatic selectivity, i.e. which will crack aromatics in preference to paraffins are preferred because of the highly aromatic character of the feed.

The preferred hydrocracking catalysts are the crystalline catalysts, generally the zeolites, and, in particular, the large pore size zeolites having a Constraint Index less than 2. For purposes of this invention, the term "zeolite" is meant to represent the class of porotectosilicates, i.e., porous crystalline silicates, that contain silicon and oxygen atoms as the major components. Other components are also present, including aluminum, gallium, oron, boron and the like, with aluminum being preferred in order to obtain the requisite acidity. Minor components may be present separately, in mixtures in the catalyst or intrinsically in the structure of the catalyst.

Zeolites with a silica-to-alumina mole ratio of at least 10:1 are useful, it is preferred to use zeolites having much higher silica-to-alumina mole ratios, i.e., ratios of at leat 50:1. The silica-to-alumina mole ratio referred to may be determined by conventional analysis. This ratio is meant to represent, as closely as possible, the ratio in the rigid anionic framework of the zeolite crystal and to exclude aluminum in the binder or in cationic or other forms within the channels.

A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g., less than 5 Angstroms. On the other hand, zeolites which provide relatively free access to the internal zeolite structure have a low value for the Constraint Index and usually pores of lrge size, e.g., greater than 8 Angstroms. The method by which Constraint Index is determined is described fully in U.S. Pat. No. 4,016,218, to which reference is made for details of the method. A Constraint Index of less than 2 and preferably less than 1 is a characteristic of the hydrocracking catalysts used in the present process.

Constraint Index (CI) values for some typical large pore materials are shown in Table 2 below:

TABLE 2

| | Constraint Index CI (Test Temperature) |
|---|---|
| ZSM-4 | 0.5 (316° C.) |
| ZSM-20 | 0.5 (371° C.) |

TABLE 2-continued

| | Constraint Index CI (Test Temperature) |
|---|---|
| TEA Mordenite | 0.4 (316° C.) |
| Mordenite | 0.5 (316° C.) |
| REY | 0.4 (316° C.) |
| Amorphous Silica-Alumina | 0.6 (538° C.) |
| Dealuminized Y (Deal Y) | 0.5 (510° C.) |
| Zeolite Beta | 0.6–2 (316°–399° C.) |

The nature of the CI parameter and the technique by which it is determined admit of the possibility that a given zeolite can be tested under somewhat different conditions and thereby exhibit different Constraint Indices. Constraint Index may vary with severity of operation (conversion) and the presence or absence of binders. Other variables, such as crystal size of the zeolite, the presence of occluded contaminants, etc., may also affect the Constraint Index. It may be possible to select test conditions, e.g., temperature, as to establish more than one value for the Constraint Index of a particular zeolite, as with zeolite beta. A zeolite is considered to have a Constraint Index within the specific range if it can be brought into the range under varying conditions.

The large pore zeolites, i.e., those zeolites having a Constraint Index less than 2 have a pore size sufficiently large to admit the vast majority of components normally found in the feeds. These zeolites are generally stated to have a pore size in excess of 7 Angstroms and are represented by zeolites having the structure of, e.g., Zeolite Beta, Zeolite X, Zeolite Y, faujasite, Ultrastable Y (USY), Dealuminized Y (Deal Y), Mordenite, ZSM-3, ZSM-4, ZSM-18 and ZSM-20. Zeolite ZSM-20 resembles faujasite in certain aspects of structure, but has a notably higher silica/alumina ratio than faujasite, as do the various forms of zeolite Y, especially USY and De-Aly. Zeolite Y is the preferred catalyst, and it is preferably used in one of its more stable forms, especially USY or De-AlY.

Although Zeolite Beta has a Constraint Index less than 2, it does not behave exactly like a typical large pore zeolite. Zeolite Beta satisfies the pore size requirements for a hydrocracking catalyst for use in the present process but it is not preferred because of its paraffin-selective behavior.

Because they are aromatic selective and have a large pore size, the amorphous hydrocracking catalysts such as alumina and silica-alumina may be used although they are not preferred.

Zeolite ZSM-4 is described in U.S. Pat. No. 3,923,639; Zeolitte ZSM-20 in U.S. Pat. No. 3,972,983; Zeolite Beta in U.S. Pat. Nos. 3,308,069 and Re 28,341; Low sodium Ultrastable Y molecular sieve (USY) is described in U.S. Pat. Nos. 3,293,192 and 3,449,070; Dealuminized Y zeolite (Deal Y) may be prepared by the method found in U.S. Pat. No. 3,442,795; and Zeolite UHP-Y is described in U.S. Pat. No. 4,401,556. Reference is made to these patents for details of these zeolite catalysts.

The catalyst should have some acidity, i.e., an alpha value greater than 1 for the cracking function. The alpha value, a measure of zeolite acidic functionality, is described together with details of its measurement in U.S. Pat. No. 4,016,218 and in *J. Catalysis,* Vol. VI, pages 278–287 (1966) and reference is made to these for such details. However, because the catalyst is being used in a fixed bed operation with a highly aromatic feed at low hydrogen pressure, it must have a low coking tending in order to reduce aging and for this reason, a low alpha value is preferred. Alpha values between 1 and 200, preferably not more than 100 are preferred, with values not more than 75 e.g. 50 being useful.

Catalyst stability during the extended cycle life is essential and this may be conferred by suitable choice of catalyst structure and composition, especially silica:alumina ratio. This ratio may be varied by initial zeolite synthesis conditions, or by subsequent dealuminization as by steaming or by substitution of frame work aluminum with other trivalent species such as boron, iron or gallium. Because of its convenience, steaming is a preferred treatment. In order to secure satisfactory catalyst stability, high silica:alumina ratios, e.g. over 50:1 are preferred, e.g. about 200:1 and these may be attained by steaming. The alkali metal content should be held at a low value, preferably below 1% and lower, e.g. below 0.5% Na. This can be achieved by successive sequential ammonium exchange followed by calcination.

Improved selectivity and other beneficial properties may be obtained by subjecting the zeolite to treatment with steam at elevated temperatures ranging from 500° to 1200° F. (399°-538° C.), and preferably 750° to 1000° F. (260°-694° C.). The treatment may be accomplished in an atmosphere of 100% steam or an atmosphere consisting of steam and a gas which is substantially inert to the zeolites. A similar treatment can be accomplished by lower temperatures and elevated pressure, e.g. 350° to 700° F. (177°-371° C.) at 10 to about 200 atmospheres.

The zeolites are preferably composited with a matrix comprising another material resistant to the temperature and other conditions employed in the process. The matrix material is useful as a binder and imparts greater resistance to the catalyst for the severe temperature, pressure and reactant feed stream velocity conditions encountered in the process. Useful matrix materials include both synthetic and naturally occurring substances, such as clay, silica and/or metal oxides. The latter may be either naturally occurring or in the form of synthetic gelatinous precipitates or gels including mixtures of silica and metal oxides such as alumina and silica-alumina. The matrix may be in the form of a cogel. Naturally occurring clays which can be composited with the zeolite include those of the montmorillonite and kaolin families. Such clays can be used in the raw state as originally mined or initially subjected to calcination, acid treatment or chemical modification. The relative proportions of zeolite component and the matrix, on an anhydrous basis, may vary widely with the zeolite content ranging from between about 1 to about 99 wt %, and more usually in the range of about 5 to about 80 wt % of the dry composite. If the feed contains greater than 20% 650° F.+material, that the binding matrix itself be an acidic material having a substantial volume of large pore size material, not less than 100 A°. The binder is preferably composited with the zeolite prior to treatments such as steaming, impregnation, exchange, etc., in order to preserve mechanical integrity and to assist impregnation with non-exchangeable metal cations.

The original cations associated with each of the crystalline silicate zeolites utilized herein may be replaced by a wide variety of other cations, according to conventional techniques. Typical replacing cations including hydrogen, ammonium and metal cations, including mixtures of these cations. Useful cations include metals such as rare earth metals, e.g., manganese, as well as metals of Group IIA and B of the Periodic Table, e.g., zinc, and Group VIII of the Periodic Table, e.g., platinum and palladium, to promote stability (as with the rare earth cations) or a desired functionality (as with the Group VI or VIII metals). Typical ion-exchange techniques are to contact the particular zeolite with a salt of the desired replacing cation. Although a wide variety of salts can be employed, particular preference is given to chlorides, nitrates and sulfates. Representative ion-exchange techniques are disclosed in a wide variety of patents, including U.S. Pat. Nos. 3,140,249; 3,140,251; and 3,140,253.

Following contact with a solution of the desired replacing cation, the zeolite is then preferably washed with water and dried at a temperature ranging from 150° to about 600° F. (65°-315° C.), and thereafter calcined in air, or other inert gas, at temperatures ranging from about 500° to 1500° F. (260°-815° C.) for periods of time ranging from 1 to 48 hours or more.

The hydrocracking catalyst is essentially free prior to use of metal components which provide hydrogenation-dehydrogenation functionality. It is therefore essentially free of metals of Groups VIA and VIIIA of the Periodic Table (IUPAC Table) such as tungsten, vanadium, zinc, molybdenum, rhenium, nickel, cobalt, chromium, manganese, or a noble metal such as platinum or palladium, although these metals may be present in amounts which do not confer significant hydrogenation functionality on the catalyst at least prior to use. During operation some metals especially nickel and vanadium may be picked up from the feed and this may confer some hydrogenation activity but this is not essential to the operation of the process.

Process Configuration

A process using a full range LCO feed is illustrated schematically in FIG. 1. A gas oil or resid feed to an FCC unit 10 is cracked in the FCC unit and the cracking products are fractionated in the cracker fractionator 11 to produce the various hydrocarbon fractions which leave the fractionator in the conventional manner. A full range of a lighter cut cycle light cycle oil (FRLCO or LCLCO)) is withdrawn from the fractionator 11 through draw-off conduit 12 and is passed to hydrotreater 15 which forms the first stage of the hydrocracking unit. The feed is hydrotreated in unit 15 to effect some aromatics saturation and to hydrogenate residual heteroatoms, especially nitrogen and sulfur, which are removed in interstage separator 16 as ammonia hydrogen sulfide together with excess hydrogen which is returned, after purificaytion, in the hydrogen circuit line 17. The interstage separation and gas purification may not be necessary but is shown here as an optional feature. The hydrotreated cycle oil then passes to hydrocracker 18 which forms the second stage of the unit in which ring opening and cracking take place to form a hydrocracked product which is rich in monocyclic aromatics in the gasoline boiling range. After hydrogen separation in separator 19, the hydrocracker effluent is fractionated in the conventional manner in distillation tower 20 to form the products including dry gas, gasoline, middle distillate and a bottoms fraction which may be withdrawn and blended into low sulfur fuel oil, or optionally recycled to FCCU 10 through recycle conduit 21. The gasoline range product from tower 20 is of high octane rating and is suitable for being blended directly into the refinery gasoline product pool without reforming or other treatment to improve octane number.

While the monofunctional catalysts used in the present hydrocracking process achieve unexpectedly long operational cycles, it may be desirable to provide some method of periodic or continuous catalyst regeneration because the cycles may not be as long as the cycles encountered in conventional hydrocracking operation, typically six months to one year. Catalyst regeneration may be provided by means of a fixed-bed, swing reactor configuration. In this type of unit two reactors are loaded with the hydrocracking catalyst; liquid is charged through the hydrofining reactor and then over one of the two hydrocracking reactors. When the second reactor attains end-of-cycle, for example, at the end of thirty days, the flow is switched to other hydrocracking reactor and the reactor containing the aged catalyst is regenerated. This procedure is continued over the entire operation with one of the hydrocracking reactors in use while the other is regenerated.

An alternative regenerative technique is to provide for continuous catalyst regeneratin by operating with a moving-bed or fluidized bed hydrocracking reactor and continuously withdrawing a portion of the catalyst from the reactor and regenerating it in a separate vessel. The hydrocracker will then have a configuration similar to that shown in U.S. Pat. No. 4,797,478 which describes a fluidized bed reactor for the conversion of methanol to hydrocarbons, using continuous catalyst regeneration in a separate vessel.

In either case, whether with swing reactor or continuous regeneration, it is preferred to operate under conditions which provide a cycle life of at least five and preferably at least ten days. In fluid bed operation it is desirable that only a small portion of the catalyst inventory require regeneration at one time. The regenerator generally requires a separate vessel as well as an air compressor; a substantial economic penalty would arise if the catalyst deactivated at a fast rate requiring a very large regeneration facility. The detrimental economic impact is compounded by the need to carry out the regeneration in a manner that avoids exposure of the catalyst to excessive heat or water vapor which would result in hydrothermal damage to the zeolite. Thus it is desirable that the catalyst does not have a fast deactivation rate. Similarly, in the case of swing reactor operation, the downtime taken up during regeneration reduces unit capacity so that again, extended cycle life is desirable.

The fact that unexpectedly long cycle durations have been achieved notwithstanding, the absence of the metal component may be attributed to the nature of the process. The preferred light cycle oil feeds contain limited amounts of high molecular weight PNA coke precursors so that coke laydown is minimized even at the low hydrogen pressures which prevail in the unit. In addition, the initial hydrotreating step over the hydrogenation catalyst effects a sufficient degree of hydrogenation to obviate the necessity of a metal function in the second stage. In order to maintain the longest cycle durations the hydrocracking catalyst should be selected for minimum coking propensity and for this purpose the Y zeolites, especially USY, are preferred. In addition, low sodium content is desirable and this may suitably be achieved by successive ammonium exchange followed by calcination.

A preliminary hydrotreating step before the hydrocracking is preferred in order to saturate polynuclear aromatics (PNAS) and to remove nitrogen and sulfur containing impurities. The bulk of the PNAS are found in the higher boiling portion of the cycle together with the bulk of the heteroatoms and accordingly the hydrotreating step may be carried out at the lower hydrotreating severity with light cut LCO feeds.

Hydrocracking Conditions

During the hydrocracking process the objective is to create monocyclic aromatics of high octane value from the aromatics in the feed. Because the feed contains principally bicyclic aromatics such as naphthalene, benzothiophene, etc., the degree of saturation during the hydrocracking step must be limited so as to avoid complete hydrogenation of these components. For this reason, relatively low to moderate hydrogen pressures are used, usually not more than 1000 psig (7000 kPa), with minimum pressures usually being about 400 psig (about 2860 kPa) and typical pressures in the range of 600–1000 psig (about 4250–7000 kPa). The exact pressure is selected according to feed characteristics (aromatic and heteroatom content), extent of preliminary hydrotreatment, catalyst stability and aging resistance and the desired product characteristics. Similarly, because ring opening is also to be limited in order to preserve the aromatic character of the gasoline product, severity (temperature, residence time, conversion) is also limited. Conversion to 385° F.−(195° C.−) gasoline should be below 80 volume percent and preferably below 65 volume percent. Although conversion may exceed 75 volume percent, conversion levels between 55 and 70 volume percent represent a typical maximum. Optimum conversion levels are from about 20 to 50 e.g. 20 to 30, volume percent for highest product octane. Because the absence of heteroatoms and PNAS from the feed reduces catalyst deactivation from heteroatom and PNA induced inhibition and coking, there is a reduced degree of necessity to relate conversion to hydrogen pressure with the LCO feeds (as described in application Ser. No. 940,328). With full range feeds, however, conversion should preferably be limited to no more than one-twentieth the hydrogen partial pressure expressed in psig, as described in U.S. Pat. No. 4,676,887. Pressures between 400 and 1000 psig (2860–7000 kPa), usually in the range 600–1000 psig (4250–7000 kPa) with conversions up to 70 volume percent are preferred. Hydrocracking temperatures are typically up to 850° F. (450° C.) although higher temperatures up to about 900° F. (480° C.) may be employed, commonly with temperature minima of about 600° F. (315° C.) or higher, e.g. 700° F. (370° C.) being a recommended minimum. Space velocity will vary with temperature and the desired level of conversion but will typically be 0.25–2.5 hr.$^{-1}$, more usually 0.5–1.5 hr.$^{-1}$ (LHSV, 20° C.). Hydrogen circulation rates of 500–5000 SCF/Bbl (90–900 n. 1.1.$^{-1}$) are suitable. Heat for the endothermic cracking reactions is readily supplied by the feed from the exothermic hydrotreating step and this factor, together with the fact that low coke make is achieved, makes fixed bed operation feasible, eliminating the need for continuous regeneration in favorable cases.

A notable feature of the present process is the low hydrogen consumption during the hydrocracking step. Compared to processes carried out under similar conditions employing a conventional bifunctional hydrocracking catalyst, the hydrogen consumption is markedly lower, especially at higher conversions. In fact, contrary to conventional hydrocracking techniques, hydrogen consumption may decline with increasing conversion. Hydrogen consumptions of less than 1300 SCF/Bbl may be readily obtained at conversions (420° F.+, 215° C.) over 20 vol. percent and consumptions below 1200 SCF/Bbl at conversions (420° F.+, 215° C.) of 20 to 40 vol. percent.

Hydrotreating

Although, as stated above, the use of two-stage hydrocracking, i.e. hydrotreating followed by hydrocracking is not preferred with light cut feeds, it is preferred with all feeds and is, in practical terms, a necessity with the higher boiling feeds, e.g. full range cycle oil. Hydrotreating will also be useful if the feed has a relatively high heteroatom content since hydrotreating with interstage separation of inorganic nitrogen and sulfur will enable extended cycle life to be obtained in the hydrocracking unit. Preliminary hydrotreating may be carried out with or without interstage separation before the hydrocracking step. If interstage separation is omitted, and cascaded operation in fixed bed reactors is employed, the hydrotreating catalyst may simply be loaded on top of the hydrocracking catalyst in the reactor.

The hydrotreating catalyst may be any suitable hydrotreating catalyst, many of which are commercially available. These are generally constituted by a metal or combination of metals having hydrogenation/dehydrogenation activity and a relatively inert, i.e. non-acidic refractory carrier having large pores (20° A or more). Suitable carriers are alumina, silica-alumina or silica and other amorphous, large pore size amorphous solids such as those mentioned above in connection with the hydrocracking catalyst binder materials. Suitable metal components are nickel, tungsten, cobalt, molybdenum, vanadium, chromium, often in such combinations as cobalt-molybdenum, nickel-molybdenum or nickel-cobalt-molybdenum. Other metals of Groups VI and VIII of the Periodic Table may also be employed. About 0.1–20 wt percent metal, usually 0.1–10 wt. percent, is typical.

Because the catalyst is relatively non-acidic (although some acidity is necessary in order to open heterocyclic rings to effect hetero atom removal) and because temperature is relatively low, conversion during the hydrotreating step will be quite low, typically below 10 volume percent and in most cases below 5 volume percent. Temperatures will usually be from 600° to 800° F. (315°–425° C.), mostly from 625° to 750° F. (330° to 400° C.). Space velocity (LHSV at 20° C.) will usually be from 0.25 to 4.0 $hr.^{-1}$, preferably 0.4 to 2.5 $hr.^{-1}$, the exact space velocity selected being dependent on the extent of hydrotreating desired and the selected optional temperature. Hydrogen pressures of 200–1000 psig (1500–7000 kPa), preferably 400–800 psig (2860–5620 kPa) are typical with hydrogen circulation rates of 500–5000 SCF/Bbl (90–9000 $n.l.l.^{-1}$) being appropriate. If cascade operation is employed, the hydrotreating pressure will be slightly higher than that desired in the hydrocracking step to allow for bed pressure drop.

The hydrotreating catalyst, like the hydrocracking catalyst, may be disposed as a fixed, fluidized, or moving bed of catalyst, although a downflow, fixed bed operation is preferred because of its simplicity.

When a preliminary hydrotreatment is employed, conditions in the hydrocracking step may be adjusted suitably to maintain the desired overall process objective, i.e. incomplete saturation of aromatics with limited ring opening of hydroaromatic components to form high octane gasoline boiling range products. Thus, if some saturation of bicyclic aromatics such as naphthalene, methyl naphthalenes and benzothiophenes is taken in the hydrotreating step, hydrogen consumption in the hydrocracking step will be reduced so that a lower temperature will result if space velocity is kept constant (since the extent of the exothermic hydrogenatio reactions will be less for the same throughput in the second stage). In order to maintain the desired level of conversion (which is dependent on temperature, it may be necessary to decrease space velocity commensurately.

Hydrocracker Products

As described above, the objective of the present process is to produce a high octane gasoline directly. The boiling range of the gasoline will typically be $C_5$–385° F. ($C_5$–196° C.) (end point) but gasolines of higher or lower end points may be encountered, depending on applicable product specifications, e.g. $C_5$–330° F. ($C_5$–165° C.) (end point) of $C_5$–450° F. ($C_5$–232° C.). Minimum target octane number is 85 clear or higher, e.g. 87 (RON+0). In most cases, higher octane ratings are attainable, for example, clear ratings of at least 90 or higher, e.g. 95. In favorable cases, clear octane ratings of 100 or higher may be attained. In all cases, the gasoline boiling range product may be blended directly into the refinery gasoline pool without reforming or other treatment to improve octane. As mentioned above, the hydrocracker bottoms fraction may be recycled to the catalytic cracking unit where its enhanced crackability as a consequence of its increased hydrogen content will further improve the total gasoline yield, this time by increasing the yield from the cracker. The hydrocracker bottoms may also be combined with the high boiling cut of the cycle oil (from fractionator 13) after it has been hydrotreated, e.g. in a conventional CHD unit form a fuel oil or diesel fuel or, alternatively, the combined stream can be recycled to the FCCU, as previously described.

The present process is notable for the production of high octane gasoline directly from the highly aromatic product from the catalytic cracking unit. The use of lower hydrogen pressures and moderate processing conditions in the hydrocracker enables this result to be achieved with low hydrogen consumption and low utility requirements.

The invention is illustrated in the following Examples.

EXAMPLE 1

A light cycle oil from a fluid catalytic cracking operation was used as feed. It had the following properties as set out in Table 3.

TABLE 3

| LCO Hydrocracking Feed | |
|---|---|
| Nominal Boiling Range, °F. (°C.) | 400–725 (204–385) |
| Gravity, API | 12.1 |
| Sulfur, wt. % | 2.8 |
| Nitrogen, ppmw | 660 |
| Hydrogen, wt. % | 9.3 |

The feed was subjected to two stage cascade hydrotreating/hydrocracking (no interstage separation) using a commercial Ni—Mo/$Al_2O_3$ hydrotreating catalyst at 675° F. (355° C.), 600 psig (4240 kPa) $H_2$ (inlet), 1 LSHV for the hydrotreating catalyst and a silica-bound, steamed ultrastable Y zeolite as the hydrocracking catalyst with no added metal component for hydrogenation functionality. Properties of the hydrocracking catalyst were shown in Table 4 below.

TABLE 4

| Monofunctional HC Catalyst | |
|---|---|
| Type | USY/$SiO_2$ |
| USY, wt. % | 65 |
| $SiO_2$, wt. % | 35 |
| Alpha | 55 |

Figure 2:
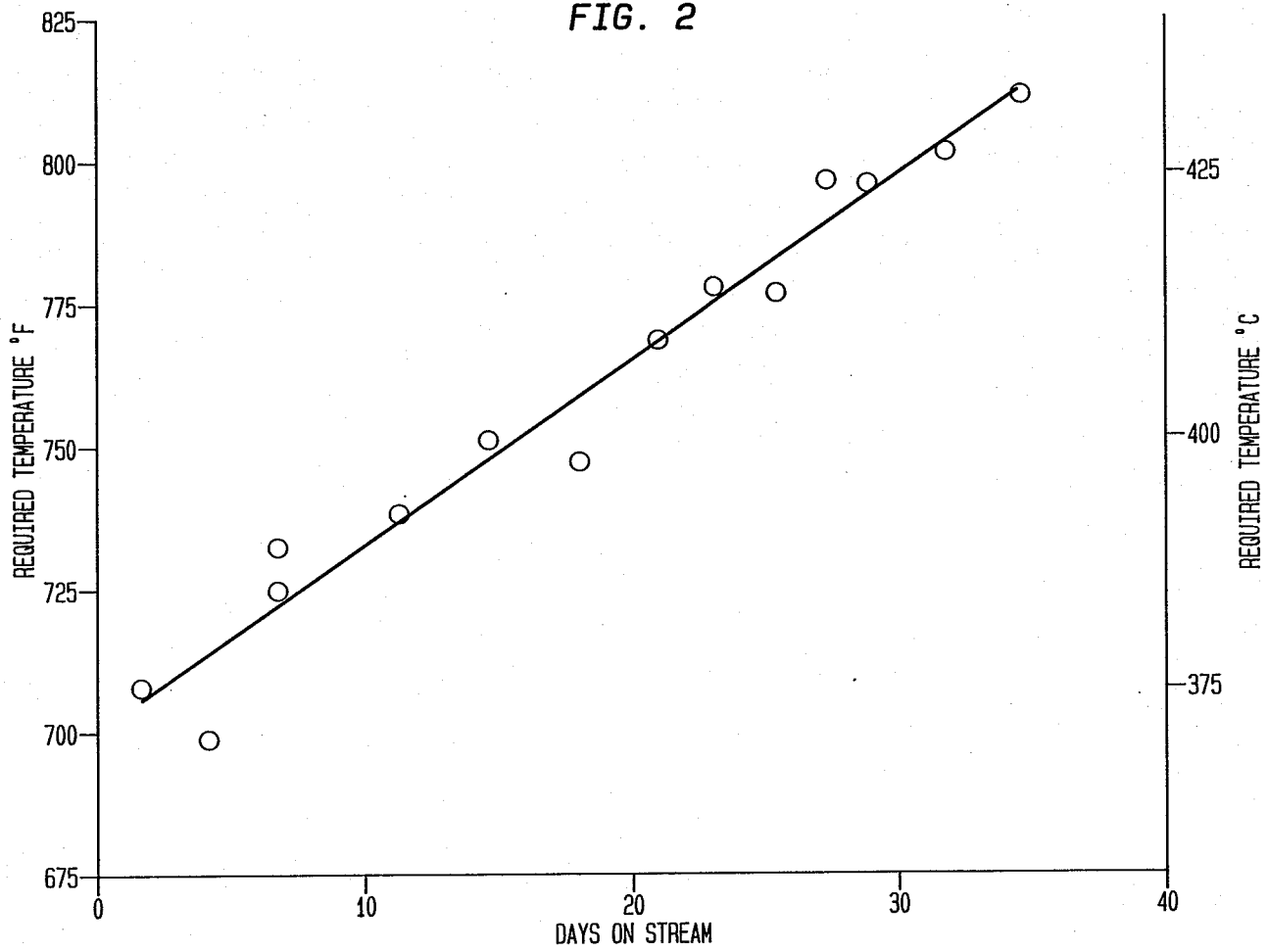
FIG. 2 is a graph showing the aging of a monofunctional hydrocracking catalyst used with a light cycle oil feed.

The hydrocracking was carried out for 38 days at 600 psig (4240 kPa) $H_2$ inlet pressure, 1 $hr^{-1}$ LHSV and temperatures ranging from 690° F. (365° C.) to 810° F. (430° C.) to maintain a constant conversion of 20 vol. % to 385° F.— (196° C.—) gasoline. The aging of the catalyst was followed by plotting the temperature required to maintain the specified conversion and the results are shown in FIG. 2. An end-of-cycle (EOC) temperature of about 800° F. (425° C.) was reached only after 30 days.

The properties of the product were as follows at 12 days TOS.

TABLE 5

| Hydrocracked Products | |
|---|---|
| Feed | LCO |
| TOS, days | 12 |
| Reactor temp., °F., (°C.) | 727 (386) |
| $H_2$ Pressure, psig (kPa) | 600 (4240) |
| LHSV, overall | 0.5 |
| Product Distribution, wt. %: | |
| $C_5$— | 4.2 |
| $C_5$—385° C. ($C_5$—195° C.) | 17.8 |
| 385°-420° F.(195-215° C.) | 4.3 |
| 420° F. + Distillate | 73.7 |
| 385° F. Gasoline RON: | 93.9 |

The results above and in FIG. 2 show that it is possible to employ a monofunctional catalyst for cracking dealkylated feeds to high octane gasoline products.

EXAMPLES 2-4

To compare performance of the dual catalyst system and one catalyst system, three additional experiments were conducted. The dual catalyst system consists of a hydrotreating catalyst and an unpromoted USY catalyst so as to separate hydrotreating function and cracking function in two individual catalysts. In the one catalyst system, a NiMo promoted USY was used to provide both hydrotreating and cracking functions. The experiments used a light cut LCO as the feedstock as in Table 6. Catalyst properties are given in Table 7. Through this summary, HDT refers to a commercial NiMo/$Al_2O_3$ hydrotreating catalyst; USY, a unpromoted USY catalyst; and NiMO USY is the NiMo version of the USY catalyst. Prior to metal additions, extrudates of the USY and NiMo USY catalysts were steamed to 55 alpha.

TABLE 6

| Feedstock Properties - Light Cut LCO | |
|---|---|
| Nominal Boiling Range, °F. (°C.) | 360-600 (182-315) |
| Gravity, API | 16.8 |
| Sulfur, wt. % | 2.7 |

TABLE 6-continued

| Feedstock Properties - Light Cut LCO | |
|---|---|
| Nitrogen, ppmw | 190 |
| Hydrogen, wt. % | 9.5 |
| Composition, vol. % | |
| Aromatics | 87 |
| Olefins | 3 |
| Saturates | 10 |

TABLE 7

| Catalyst Properties | | | |
|---|---|---|---|
| Catalyst | HDT | USY | NiMo/USY |
| Type | Hydro-treating | Monofunctional Hydrocracking | Bifunctional Hydrocracking |
| Composition, wt % | | | |
| USY zeolite(2) | non | 65(1) | 65(1) |
| Nickel/oxide | 4.5 | — | 4.8 |
| Molybdenum | 20.0 | — | 9.3 |
| Aluminum | balance | balance | balance |

Notes:
(1)prior to metal additions
(2)steamed to 65 alpha activity measured prior to metal additions Three experiments were conducted: Examples 2 and 3 used the dual catalyst system, and Example 4 used the one catalyst system. For Examples 2 and 3, the hydrotreating catalyst and USY catalyst were loaded in separate reactors in a 50/50 volumetric ratio and operated in cascade mode without an interstage separation of $H_2S$ and $NH_3$. During the experiments, the USY catalyst temperature was varied to cover a wide range conversion, while hydrotreating catalyst temperature was kept constant at 610° and 685° F. (320° and 365° C.), for Example 2 and Example 3, respectively. Detailed experimental conditions are summarized in Table 8 below.

TABLE 8

| Experimental Conditions | | | |
|---|---|---|---|
| | Example 2 | Example 3 | Example 4 |
| Pressure, psig (kPa abs) | 600(4240) | 600(4240) | 600(4240) |
| Catalyst: | HDT/USY | HDT/USY | NiMo/USY |
| Catalyst Ratio | 1:1 | 1:1 | — |
| $H_2$ circ., SCF/B(n.1.1.$^{-1}$ | 5000(890) | 5000(890) | 5000(890) |
| Reactor Temp, °F.(°C.) | | | |
| HDT | 610(320 | 685(363) | — |
| USY | 600-750 (315-400) | 700-772 (370-110) | 600-730 (315-390) |
| Overall LHSV, $hr^{-1}$ | 0.8 | 0.8 | 0.5-0.8 |
| 420° F.+ conversion, pct. | 15-40 | 25-35 | 20-60 |

The results are given in Table 9 below and in FIGS. 3 and 4. Table 9 gives the $C_4$ hydrocarbon distribution at fixed conversion levels while FIGS. 3 and 4 show the gasoline product octane (R+0) and hdrogen consumption, respectively, at the different conversion levels employed.

TABLE 9

| $C_4$ Hydrocarbon Distribution | | | |
|---|---|---|---|
| | Example 2 | Example 3 | Example 4 |
| 420° F.+ conv, pct | 40 | 29 | 38 |
| Catalyst | HDT/USY | HDT/USY | NiMo/USY |
| $C_4$ Distribution, pct. | | | |
| i-$C_4$ | 75 | 65 | 35 |
| $C_4$= | 5 | 23 | 10 |
| N—$C_4$ | 20 | 12 | 65 |

Figure 3:
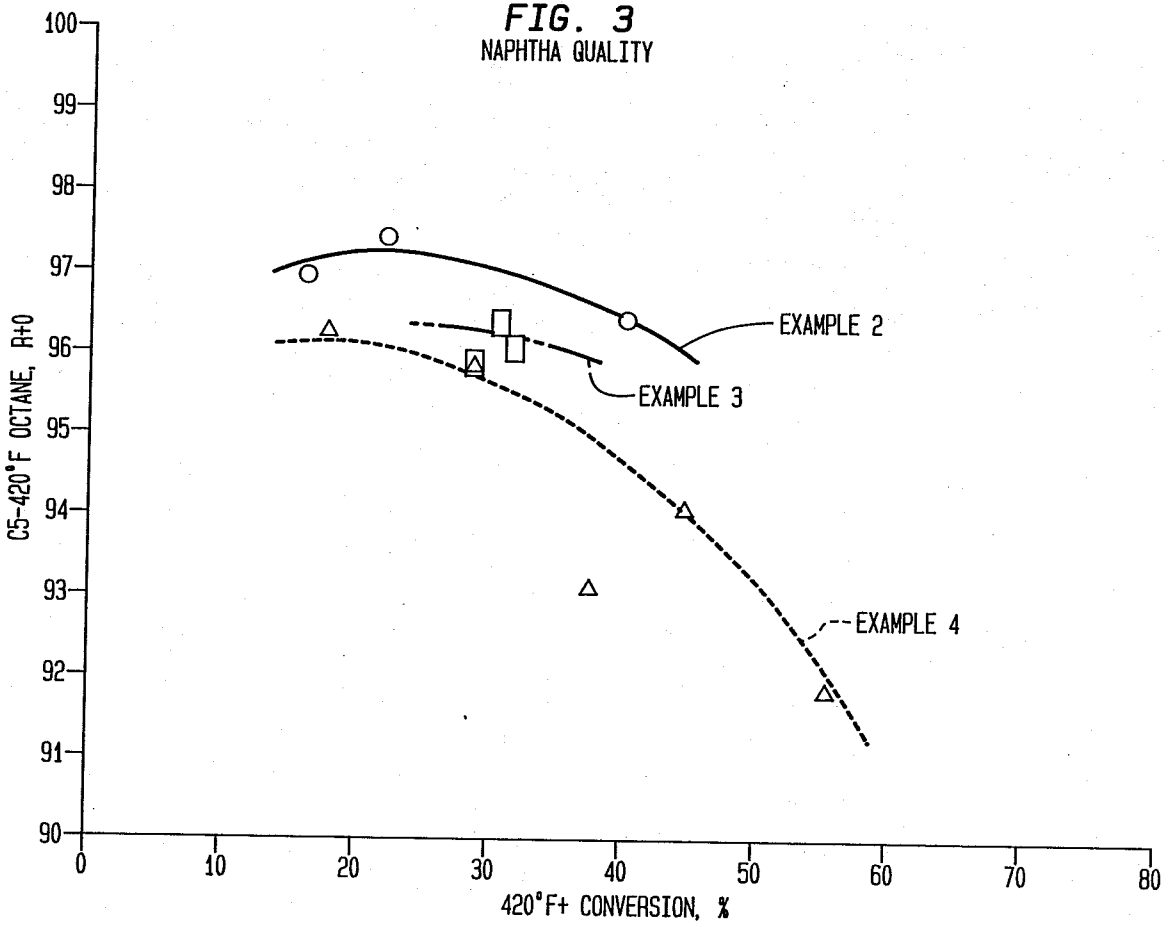
FIG. 3 is a graph showing the gasoline product octane (R+0) at various conversion levels with a monofunctional catalyst.
Figure 4:
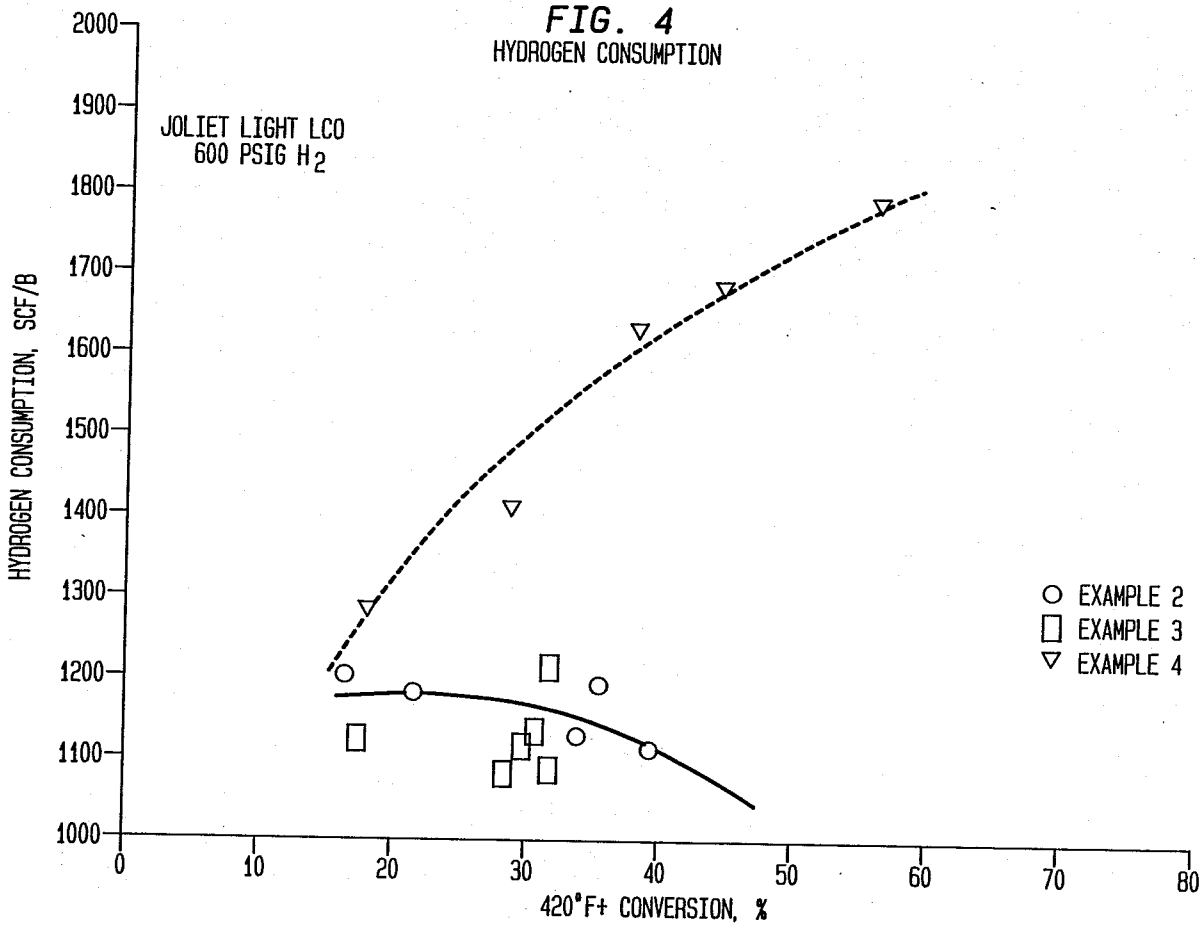
FIG. 4 is a graph showing the hydrogen consumption at various conversion levels with a monofunctional catalyst.

Results showed unexpectedly that the HDT/USY catalyst system (Examples 2 and 3) produces naphthas having an octane (R+O) higher than the NiMo USY catalyst (Example 4) over the conversion range studied (FIG. 3). (Note: conversion is defined as percentage of 420° F.+ (215° C.+) materials in the feed converted to the 420° F.− (215° C.−) materials. At equivalent conversion, the HDT/USY catalyst system makes slightly more C1-C4 light gases. However, the C4s produced from the HDT/USY catalyst system (Examples 2 and 3) are rich in iso-butane and butenes, and can be directly blended into the alkylation feeds to further increase gasoline yield. Table 9 above compares C4 stream compositions for the three examples. Total iso-butane and butenes concentrations for Examples 2 and 3 are greater than 80%, compared to 45% for Example 4.

Additionally, the HDT/USY catalyst system consumes less hydrogen than the NiMo USY catalyst, particularly at high conversion as shown in FIG. 4.

We claim:

1. A process for producing a gasoline, which comprises hydrocracking a highly aromatic, substantially dealkylated hydrocarbon feed having an initial boiling point of at least 300° F., an end point up to about 750° F., an aromatic content of at least 50 weight percent, and a hydrogen content not more than 12.5 weight percent in the presence of hydrogen and a solid, porous monofunctional acidic cracking catalyst at a hydrogen partial pressure of not more than 1000 psig and a conversion of not more than 55 volume percent to gasoline boiling range products.

2. A process according to claim 1 in which the feed has an aromatic content of at least 60 weight percent.

3. A process according to claim 1 in which the feed has an aromatic content of at least 70 weight percent.

4. A process according to claim 1 in which the feed has a hydrogen content of 8.5 to 12.5 weight percent.

5. A process according to claim 1 inwhich the feed has an API gravity not more than 25.

6. A process according to claim 1 in which the feed has an API gravity not more than 20.

7. A process according to claim 1 in which the feed has an API gravity of 5 to 25.

8. A process according to claim 1 in which the hydrogen partial pressure is from 600 to 1000 psig.

9. A process according to claim 1 in which the conversion is not more than 0.05 times the hydrogen partial pressure expressed in psig.

10. A process according to claim 9 in which the feed has an end point in excess of 650° F. and up to about 750° F.

11. A process according to claim 9 in which the hydrocracking catalyst comprises a large pore size crystalline aluminosilicate zeolite.

12. A process according to claim 11 in which the zeolite comprises a zeolite having the structure of zeolite Y.

13. A process according to claim 11 in which the zeolite comprises zeolite Y, zeolite USY, or zeolite de-Aly.

14. A process according to claim 12 in which the zeolite has an alpha value up to 100.

15. A process according to claim 1 in which the hydrocracked, gasoline boiling range product has an octane rating of at least 87 (RON+0).

16. A process according to claim 1 in which the hydrocracked, gasoline boiling range product has an octane rating of at least 90.

17. A method according to claim 1 in which the feed is hydrotreated before being hydrocracked.

18. A method for the production of a high octane, hydrocracked gasoline, which comprises hydrocracking a highly aromatic light cut light cycle oil of the following properties:

| | |
|---|---|
| API° | not more than 25 |
| Boiling range | 300°-650° F. |
| Hydrogen content | 8.5-12.5 wt. pct. |
| Aromatic content | at least 60 wt. pct. |
| in the presence of hydrogen under the following conditions: | |
| Temperature | 700°-850° F. |
| $H_2$ partial pressure | 600-100 psig |
| 385° F.+ conversion | Not more than 50 vol. pct. |

in the presence of a hydrocracking catalyst comprising an monofunctional, aromatic-selective, large pore size crystalline, aluminosilicate zeolite having acidic functionality with an alpha value up to 100, to form a hydrocracked gasoline boiling range product having an octane number of at least 87 (RON+0).

19. A process according to claim 18 in which the zeolite is zeolite Y, zeolite USY or de-Aly.

20. A process according to claim 18 in which the conversion to gasoline boiling range products is 20 to 50 volume percent.

21. A process according to claim 18 in which the product gasoline has an octane number of at least 90 (RON+0).

22. A method for the production of a high octane, gasoline boiling range product which comprises hydrotreating a highly aromatic, dealkylated hydrocrabon feed having an initial boiling point of 300°-750° F., an aromatic content of at least 60 wt. pct., an API gravity of not more than 25, a hydrogen content of 8.5 to 12.5 wt. pct., contacting the hydrotreated feed in the presence of hydrogen with a monofunctional, acidic cracking catalyst comprising an aromatic-selective, large pore size crystalline aluminosilicate zeolite having cracking activity and an alpha value up to 100, at a hydrogen partial pressure of 600° to 850° F., a 385° F.+ conversion of not more than 50 vol. percent, to form a hydrocracked gasoline boiling range product having an octane number (RON+0) of at least 87.

23. A method according to claim 22 in which the hydrogen consumption is less than 1300 standard cubic feet per barrel (SCF/bbl) at a conversion (420° F.+) of at least 20 vol. pct.

24. A method according to claim 23 in which the hydrogen consumption is less than 1200 standard cubic feet per barrel (SCF/bbl) at a conversion (420° F.+) of 20 to 40 vol. pct.

* * * * *